US010322319B2

(12) United States Patent
Del Rosario et al.

(10) Patent No.: US 10,322,319 B2
(45) Date of Patent: Jun. 18, 2019

(54) GOLF CLUB HEAD WITH HOSEL SUPPORT STRUCTURE

(71) Applicant: Callaway Golf Company, Carlsbad, CA (US)

(72) Inventors: Justin Del Rosario, Temecula, CA (US); Romulus M. Tomimbang, San Diego, CA (US); Kevin Harper, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 16/133,698

(22) Filed: Sep. 18, 2018

(65) Prior Publication Data

US 2019/0022472 A1 Jan. 24, 2019

Related U.S. Application Data

(63) Continuation-in-part of application No. 15/709,015, filed on Sep. 19, 2017, now Pat. No. 10,076,687.

(60) Provisional application No. 62/408,139, filed on Oct. 14, 2016.

(51) Int. Cl.

| | |
|---|---|
| ***A63B 53/04*** | (2015.01) |
| ***A63B 53/02*** | (2015.01) |
| ***A63B 53/06*** | (2015.01) |
| *A63B 102/32* | (2015.01) |

(52) U.S. Cl.

CPC ..... *A63B 53/02* (2013.01); *A63B 53/0466* (2013.01); *A63B 53/06* (2013.01); *A63B 53/047* (2013.01); *A63B 53/0487* (2013.01); *A63B 2053/023* (2013.01); *A63B 2053/0408* (2013.01); *A63B 2053/0412* (2013.01); *A63B 2053/0491* (2013.01); *A63B 2102/32* (2015.10)

(58) Field of Classification Search

CPC ..... A63B 53/02; A63B 53/0466; A63B 53/06; A63B 53/0487; A63B 2053/0491; A63B 2053/0412; A63B 2053/0408; A63B 2102/32; A63B 53/047; A63B 2053/023

See application file for complete search history.

(56) References Cited

U.S. PATENT DOCUMENTS

| | | | | |
|---|---|---|---|---|
| 7,651,414 | B2 * | 1/2010 | Rae | A63B 53/0466 473/346 |
| 7,850,543 | B2 * | 12/2010 | Rice | A63B 60/00 473/329 |
| 8,376,878 | B2 * | 2/2013 | Bennett | A63B 53/0475 473/334 |
| 8,758,164 | B2 * | 6/2014 | Breier | A63B 53/0466 473/332 |

(Continued)

*Primary Examiner* — Stephen L Blau

(74) *Attorney, Agent, or Firm* — Rebecca Hanovice; Michael Catania; Sonia Lari

(57) ABSTRACT

A golf club head having a hosel, a hollow interior, and a support structure disposed within the hollow interior proximate a flange region is disclosed herein. In particular, the present invention is directed to a fairway wood head comprising a body with a front wall, an upper opening, a return portion between the front wall and the upper opening, a hosel, an interface between the hosel and the heel side of the body, and a hosel support ring or support rod, and a composite crown affixed to the body to close the upper opening and define a hollow interior. The support structure reduces the stresses placed on, for example, the crown during hosel bending processes.

17 Claims, 15 Drawing Sheets

(56) References Cited

U.S. PATENT DOCUMENTS

| | | | | |
|---|---|---|---|---|
| 9,033,818 | B2 * | 5/2015 | Myrhum | A63B 53/0466 473/329 |
| 9,067,110 | B1 * | 6/2015 | Seluga | A63B 53/0466 |
| 9,968,834 | B1 * | 5/2018 | Seluga | A63B 53/0466 |
| 2011/0152001 | A1 * | 6/2011 | Hirano | A63B 53/0466 473/337 |
| 2011/0172027 | A1 * | 7/2011 | Hirsch | A63B 53/0466 473/332 |
| 2014/0004972 | A1 * | 1/2014 | Thomas | A63B 53/0466 473/332 |
| 2018/0369658 | A1 * | 12/2018 | Franklin | A63B 53/0466 |
| 2019/0022479 | A1 * | 1/2019 | James | A63B 60/52 |

* cited by examiner

GOLF CLUB HEAD WITH HOSEL SUPPORT STRUCTURE

CROSS REFERENCES TO RELATED APPLICATIONS

The present application is a continuation-in-part of U.S. patent application Ser. No. 15/709,015, filed on Sep. 19, 2017, and issued on Sep. 18, 2018, as U.S. Pat. No. 10,076,687, which claims priority to U.S. Provisional Patent Application No. 62/408,139, filed on Oct. 14, 2016, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head having a bendable hosel and an internal support structure located proximate the hosel to reduce stresses placed on certain areas of the golf club head during hosel bending processes.

Description of the Related Art

When a golf club is fitted to a particular golfer, the lie, loft, and/or face angle of the golf club may be adjusted by bending the hosel portion of the club. This process places a great deal of stress on the hosel and the surrounding regions of the club head, however, which leads manufacturers to place extra material at the hosel to increase its durability. This increased mass at the hosel region raises the center of gravity of the club head, which is undesirable in many golf club heads, including wood-type heads such as fairway woods and drivers, and also negatively affects other mass properties of the golf club heads. Furthermore, increasing the durability of the hosel by itself does not protect the crown of the club head when the crown is formed from a non-metal material such as composite. Composite crowns tend to be extremely thin, and bending the hosel of a club head having a metal body and a composite crown often leads to unwanted warping or breakage in the crown and/or failure of adhesive material connecting the crown to the body. Therefore, there is a need for a golf club head having a lightweight, bendable hosel and a body structure that adequately distributes the stresses created by bending processes.

BRIEF SUMMARY OF THE INVENTION

One aspect of the present invention is a golf club head comprising a body comprising a sole, a heel side, a toe side, a front wall, a rear side opposite the front wall, a return portion extending away from the front wall towards the rear side, a front opening in the front wall, a hollow interior, and an upper opening, a hosel connected to the body at the heel side, the hosel comprising a tube portion and a shaft receiving bore, a face component affixed to the body to close the front opening, a flange region defined as an interface between the tube portion and the body, a crown affixed to the body to close the upper opening and enclose the hollow interior, and a support rod disposed within the hollow interior, wherein the support rod extends from the sole to the return portion proximate the flange region, wherein the support rod is disposed entirely behind the hosel along a horizontal, front-to rear x-axis, and heel-ward of a vertical xz plane extending through a heel-most side of the front opening.

In some embodiments, the golf club head may further comprise a bond flange, which may encircle the upper opening. In other embodiments, the golf club head may be selected from the group consisting of a fairway wood, a driver, and a hybrid. In still other embodiments, the body may be composed of a first material having a first density, the hosel may be composed of a second material having a second density, the crown may be composed of a third material having a third density, and the first density may be greater than the second density and the third density. In a further embodiment, the first material may be a metal alloy, and the third material may be a carbon composite. In a further embodiment, the second material may be an aluminum alloy. In any of these embodiments, the support rod may be integrally cast with the body, and in a further embodiment, the hosel may also be integrally cast with the body.

In another embodiment, the body may be composed of a first material having a first density, the support rod may be composed of a second material having a second density, and the first density may be greater than the second density. In yet another embodiment, the body may be integrally cast with the hosel and the support rod from a material selected from the group consisting of titanium alloy and steel, and the crown may be composed of a carbon composite material. In any of the embodiments, the golf club head may have a volume of 50 to 250 cubic centimeters. In another embodiment, the golf club head may further comprise at least one of a weight port and a weight lip, and in a further embodiment, the golf club head comprises two weight ports and a weight lip.

Another aspect of the present invention is a wood-type golf club head comprising a cast metal body comprising a sole, a heel side, a toe side, a front wall, a rear side opposite the front wall, a return portion extending away from the front wall towards the rear side, an upper opening, a front opening in the front wall, a hosel, a flange region, a support rod, and a volume of 50-250 cubic centimeters, a face component affixed to the body to close the front opening, and a carbon composite crown affixed to the body to close the upper opening and define a hollow interior, wherein the flange region is defined as an interface between the hosel and the rest of the body, wherein the support rod is disposed within the hollow interior proximate the flange region and extends from the sole to the return portion approximately parallel with the front wall, and wherein the support rod is disposed entirely behind the hosel along a horizontal, front-to rear x-axis, and heel-ward of a vertical xz plane extending through a heel-most side of the front opening.

In some embodiments, the wood-type golf club head may further comprise a bond flange, which may encircle the upper opening, and the crown may be permanently affixed to an exterior surface of the bond flange with an adhesive material. In a further embodiment, the wood-type golf club head may comprise at least one of a weight port and a weight lip, and may in some embodiments, comprise one or more weight ports and a weight lip.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 14:
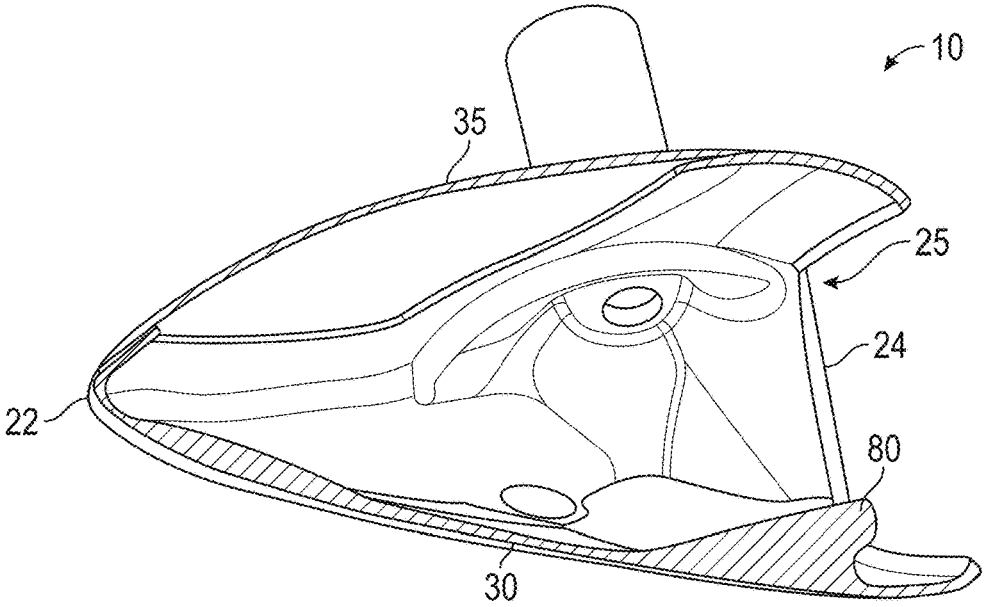
FIG. 14 is a cross-sectional view of a second embodiment of the golf club head of the present invention.
Figure 15:
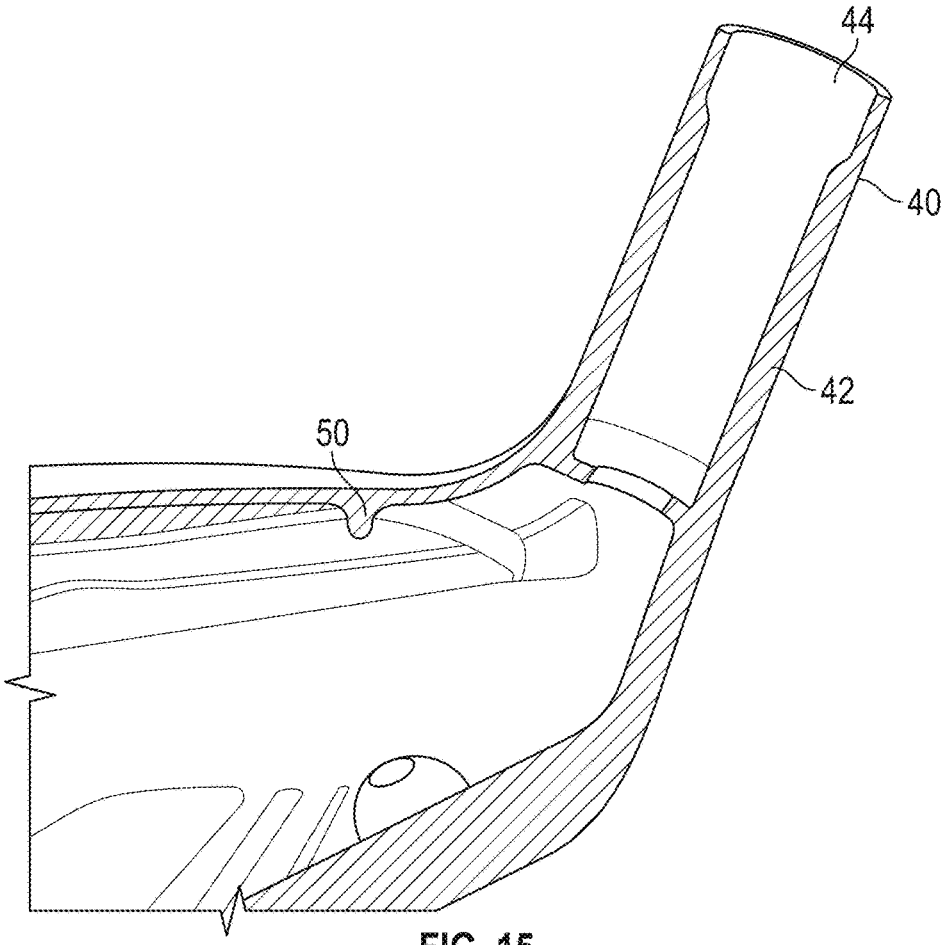
FIG. 15 is another cross-sectional view of the embodiment shown in FIG. 15.
Figure 19:
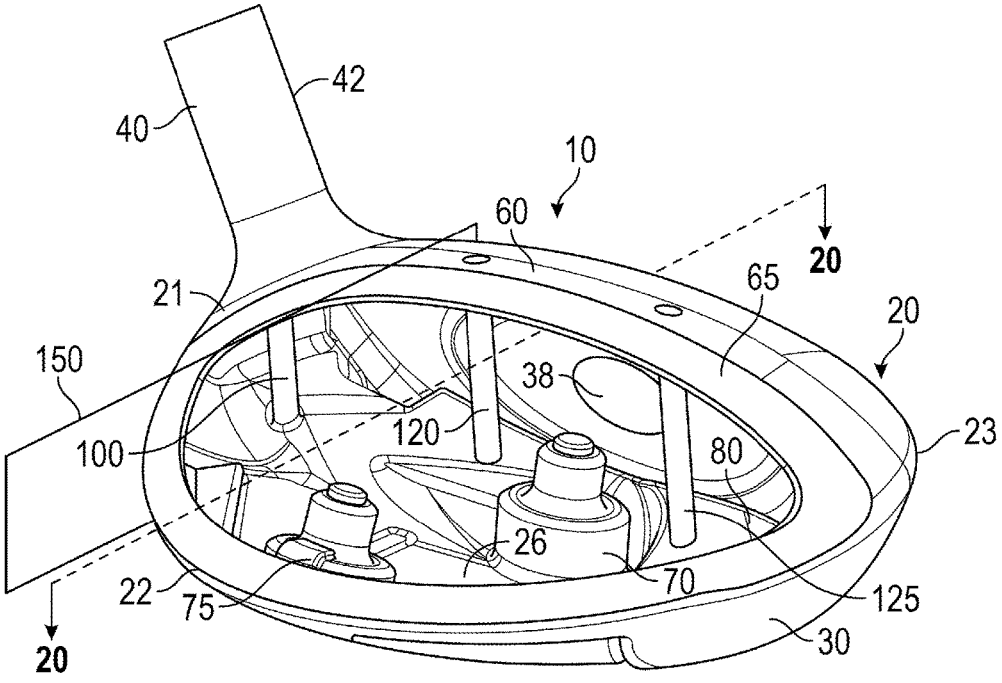
FIG. 19 is a perspective view of a third embodiment of the golf club head of the present invention without a crown.
Figure 20:
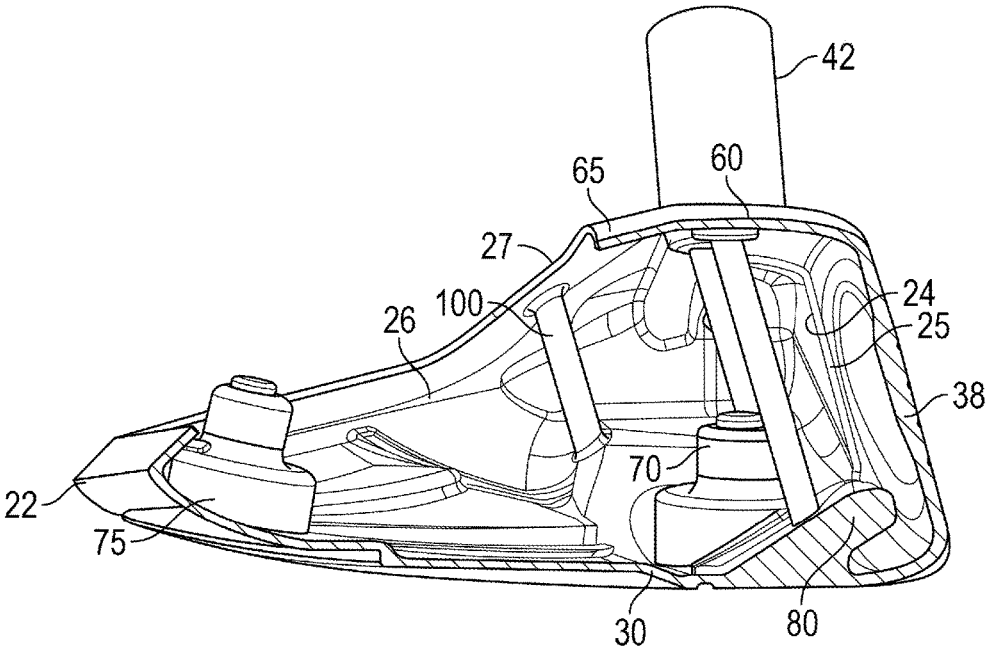
FIG. 20 is a cross-sectional view of the embodiment shown in FIG. 19.

The present invention is directed to a golf club head having a body with a face, sole, crown, hosel, and hollow interior, and a support structure disposed within the hollow interior proximate the hosel and supporting the area surrounding the hosel. A first embodiment of this golf club head 10 is shown in FIGS. 1-9, a second embodiment of this golf club head 10 is shown in FIGS. 14-15, and a preferred embodiment is shown in FIGS. 19-20. Though each embodiment of the golf club head 10 of the present invention is illustrated as a fairway wood or low-volume driver, the inventive concept can be used in connection with other types of hollow-body golf club heads, including drivers, irons, hybrids, and putters.

The first embodiment of the golf club head 10 includes a body 20 having a sole 30, a hosel 40 located at a heel side 21, a rear side 22, a toe side 23, a front wall 24 with an opening 25, a return portion 60 extending away from the front wall 24 towards the rear side 22 of the body 20, a support ring 50, a hollow interior 26, and an upper opening 27 encircled by a bond flange 65, a crown 35 sized to cover the upper opening 27, and a face component 38 sized to cover the opening 25. The body 20 also includes a front-side weight port 70 and a rear-side weight port 75, which are approximately aligned with one another along a horizontal x-axis extending perpendicular to the front wall 24.

The hosel 40 preferably includes a tube portion 42 with a shaft-receiving bore 44 and an internal shelf portion 48, against which the end of a shaft (not shown) abuts, protruding into the hollow interior 26 of the body 20. A flange region 46 is defined as the interface between the tube portion 42 and the remainder of the body 20. The internal shelf portion 48 is at least partially encircled by the support ring 50, which is entirely located within the hollow interior 26 of the body and has a maximum vertical length Lr of at least 0.050 inch, and more preferably approximately 0.125 inch, and a maximum thickness Tr of at least 0.010 inch, and more preferably approximately 0.060 inch. The support ring 50 extends from the heel side 21 of the body 20, follows the circumference of the flange region 46, and blends into the return portion 60 at the uppermost edge of the inner surface of the front wall 24.

Figure 1:
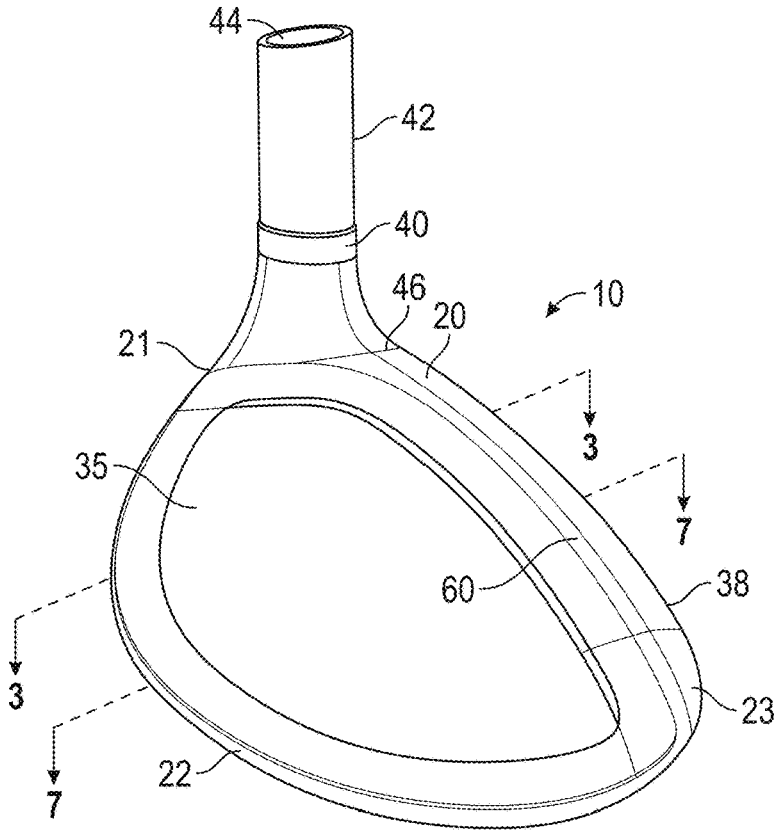
FIG. 1 is a top perspective view of a first embodiment of the present invention.
Figure 2:
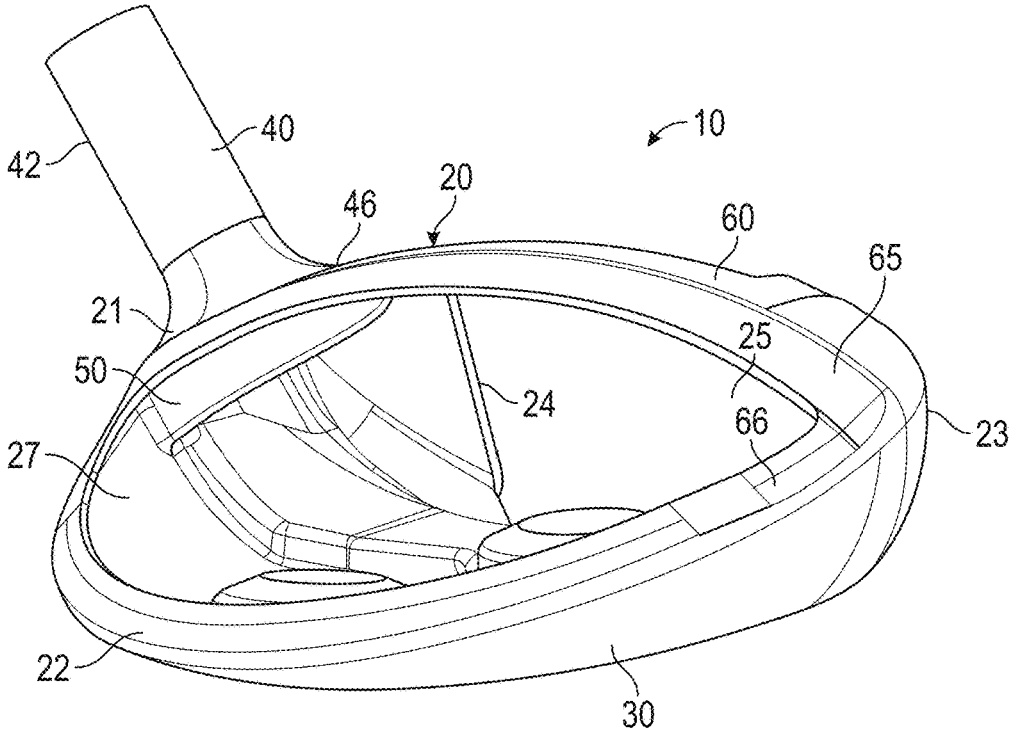
FIG. 2 is rear perspective view of the embodiment shown in FIG. 1 with its face component and crown removed
Figure 3:
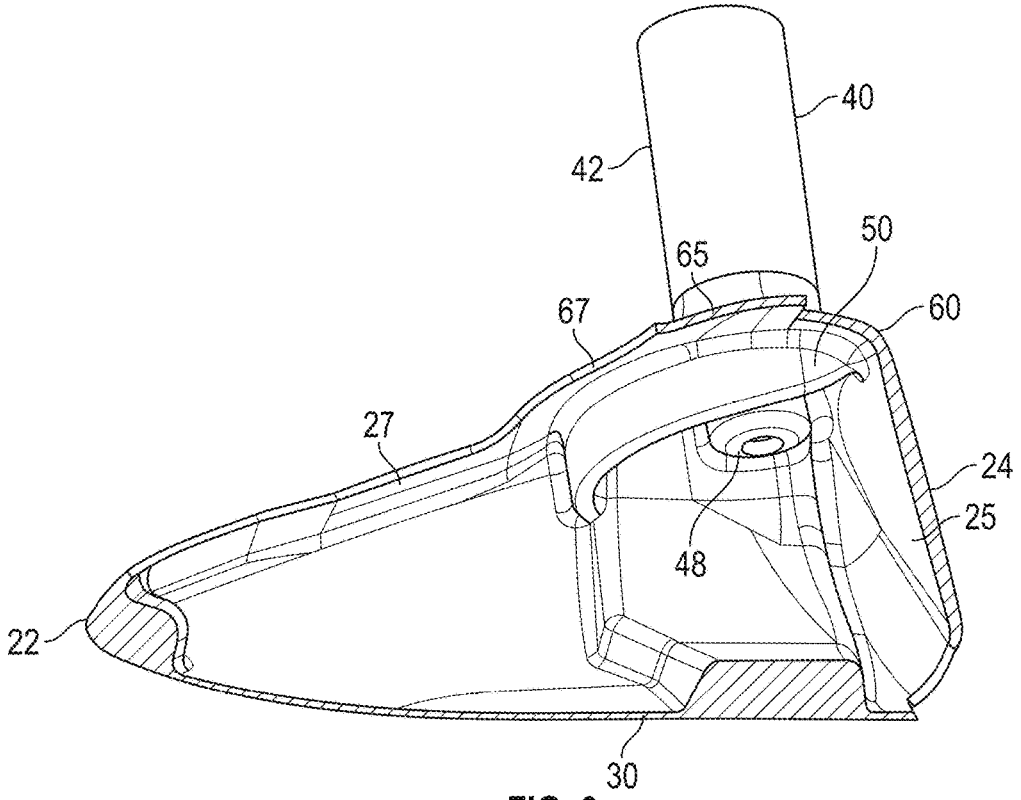
FIG. 3 is a cross-sectional view of the embodiment shown in FIG. 1 along lines 3-3.
Figure 4:
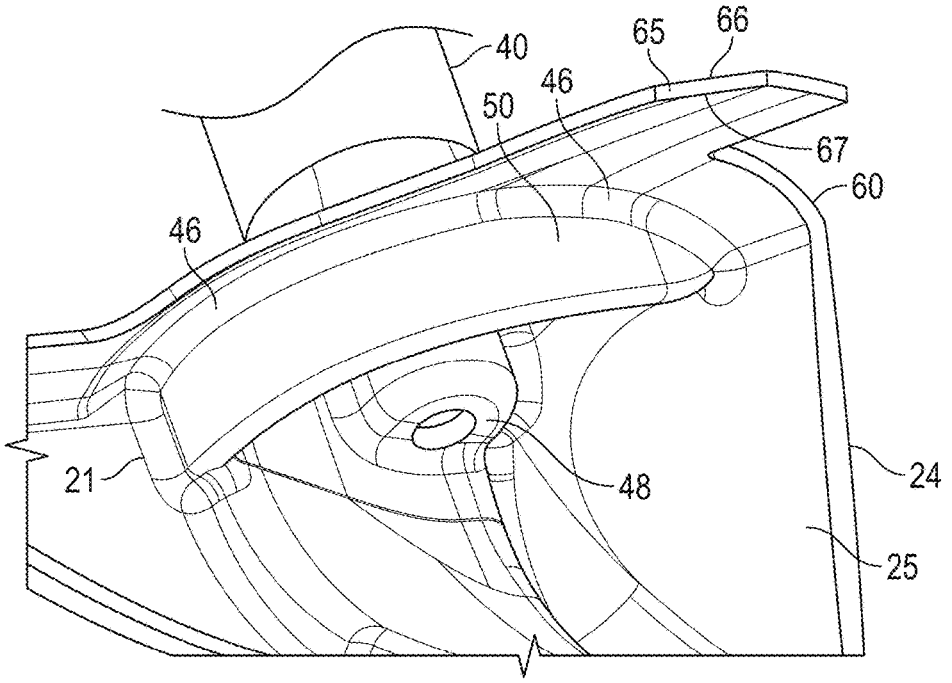
FIG. 4 is an enlarged view of the circled portion of the embodiment shown in FIG. 3.
Figure 5:
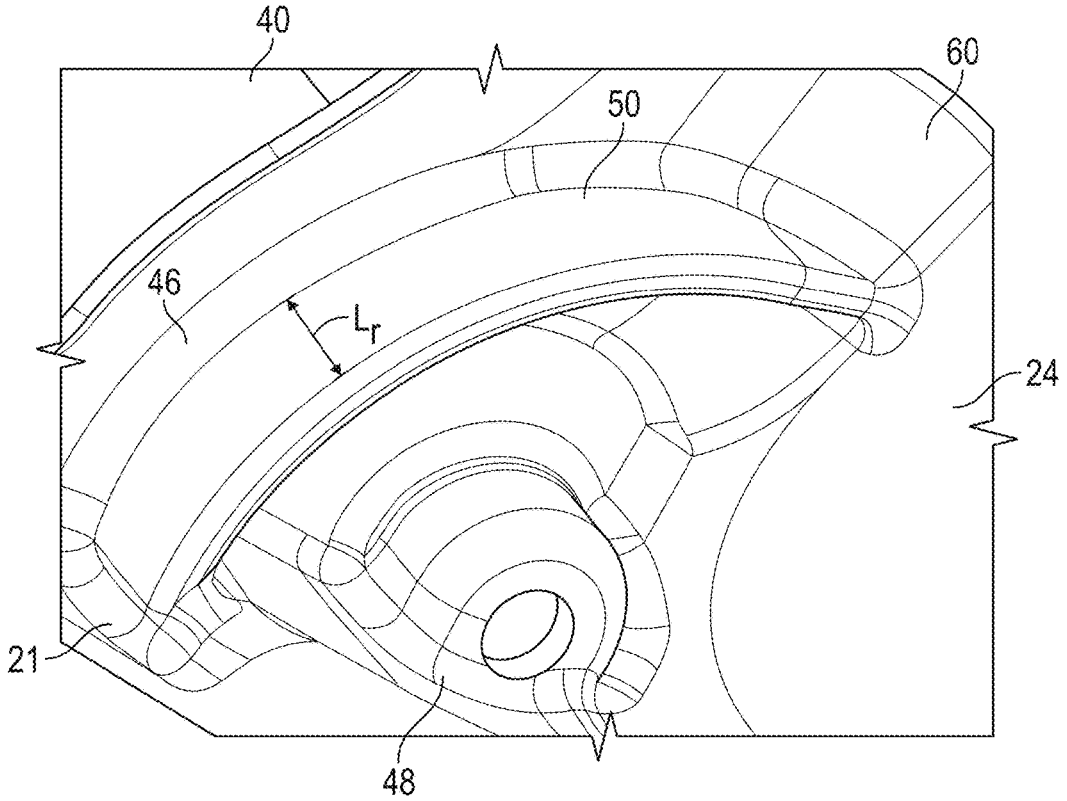
FIG. 5 is an enlarged view of the circled portion of the embodiment shown in FIG. 4.
Figure 6:
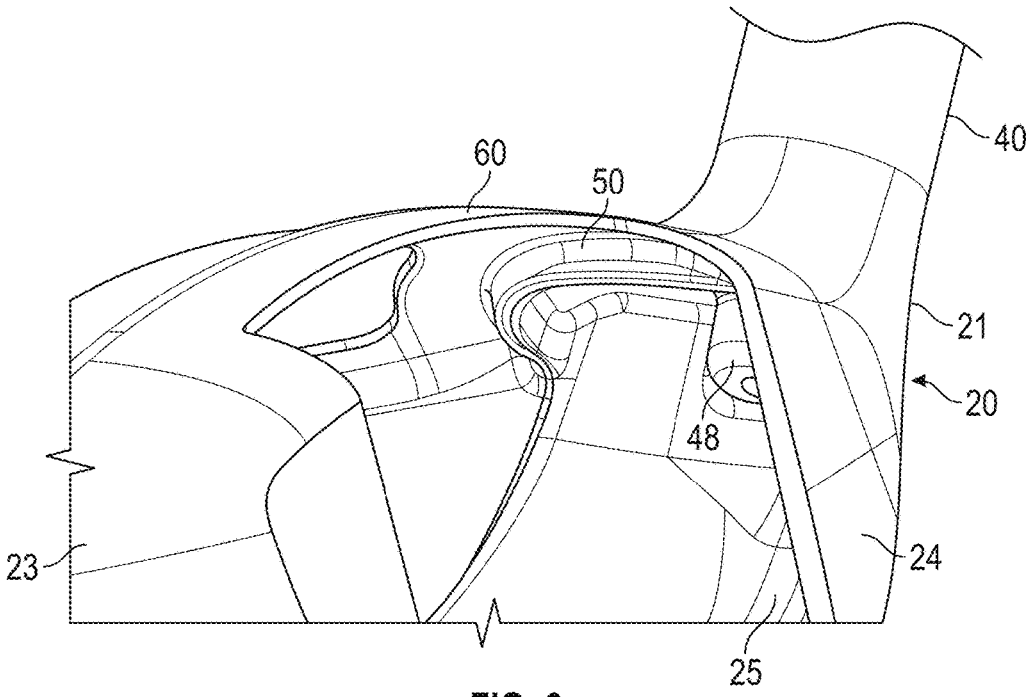
FIG. 6 is front perspective view of the embodiment shown in FIG. 2.
Figure 7:
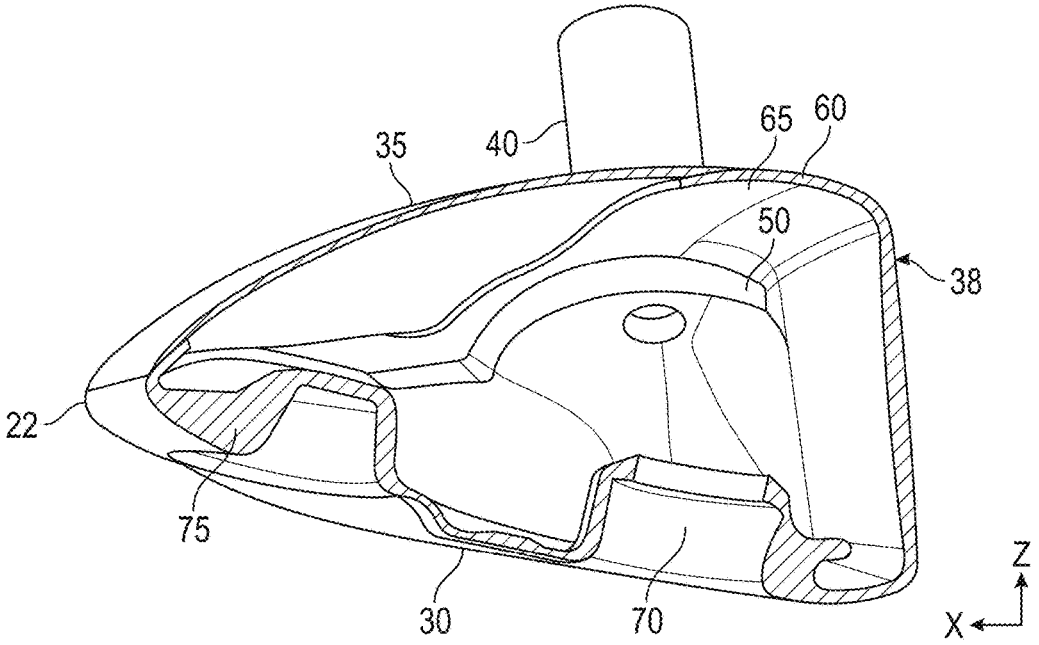
FIG. 7 is a cross-sectional view of the embodiment shown in FIG. 1 along lines 7-7.
Figure 8:
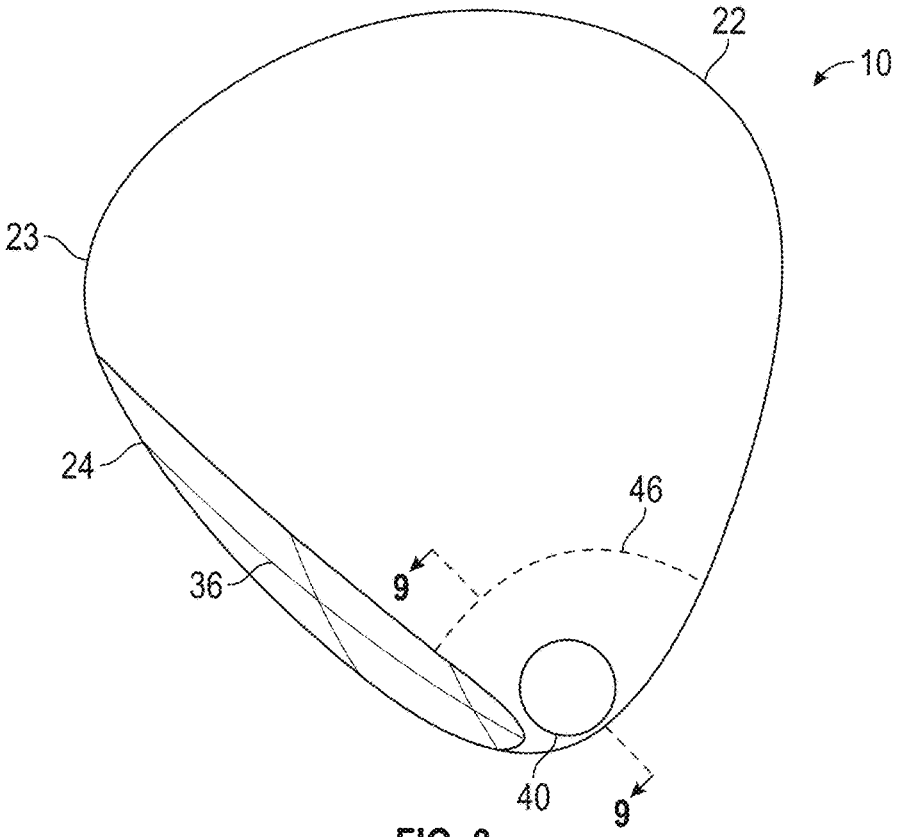
FIG. 8 is a top plan view of the embodiment shown in FIG. 1.
Figure 9:
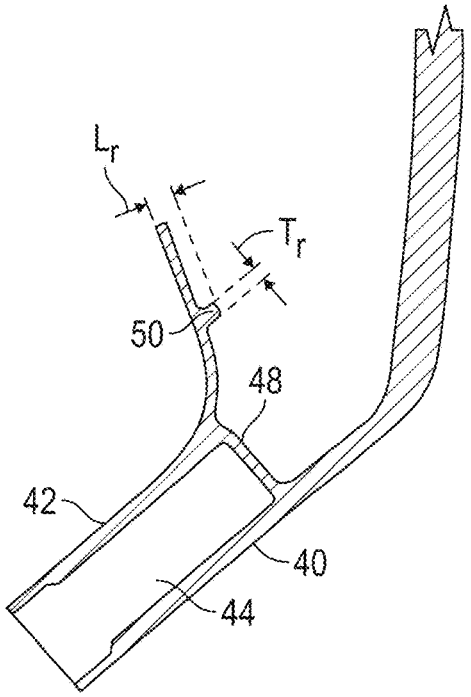
FIG. 9 is a cross-sectional view of the embodiment shown in FIG. 8 along lines 9-9.
Figure 10A:
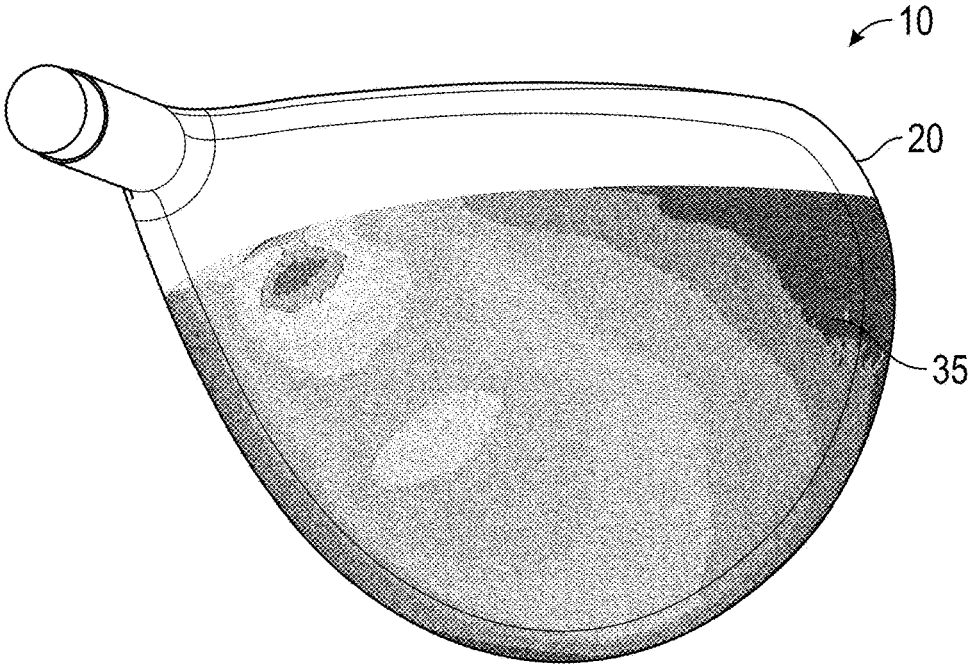
FIGS. 10A and 10B are crown stress contour plots of CAD models of golf club heads undergoing a flat lie bending process.
Figure 10B:
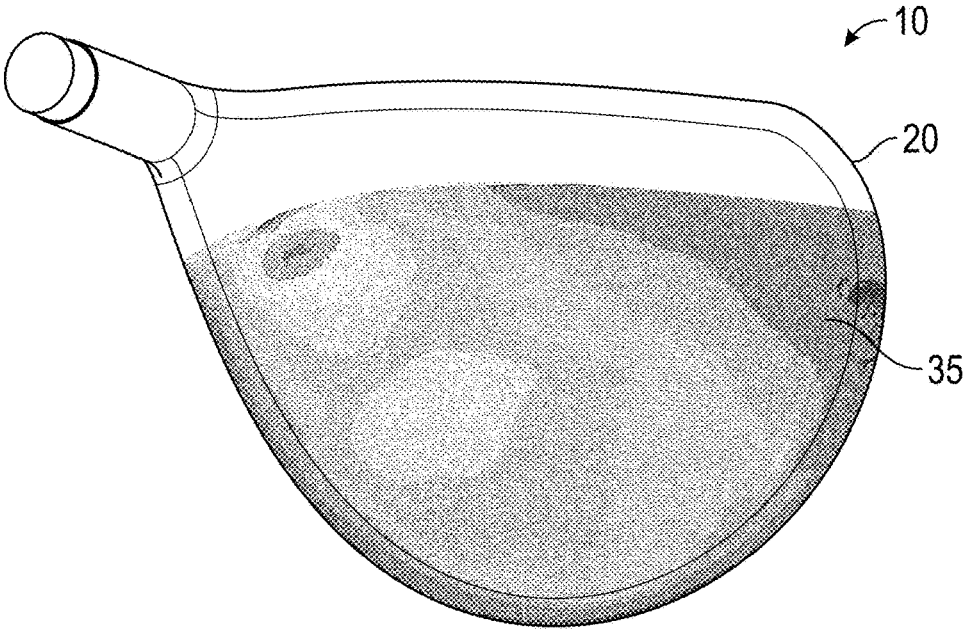
Figure 11A:
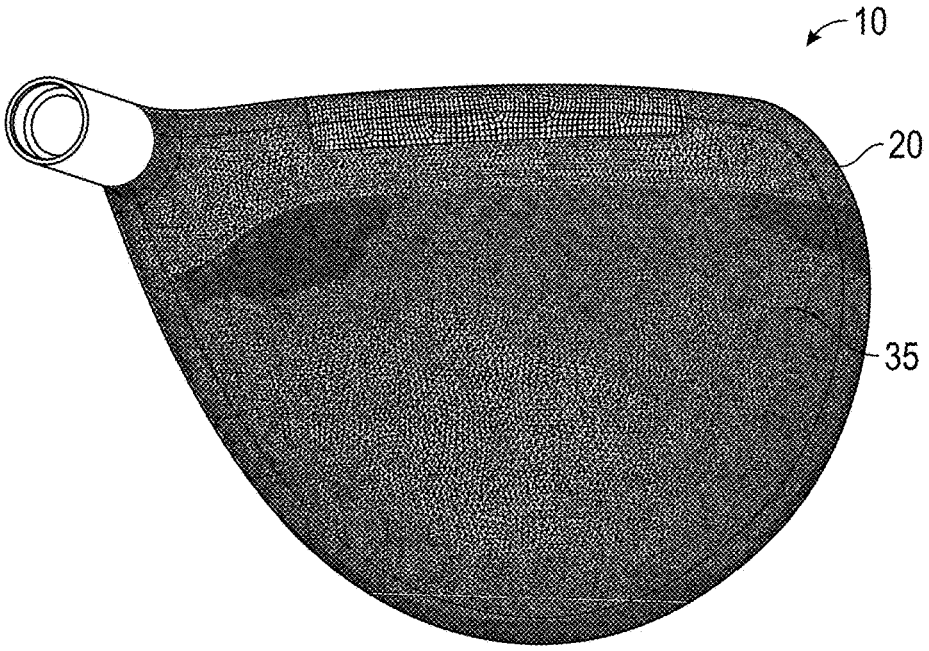
FIGS. 11A and 11B are crown stress contour plots of CAD models of golf club heads undergoing a strong loft bending process.
Figure 11B:
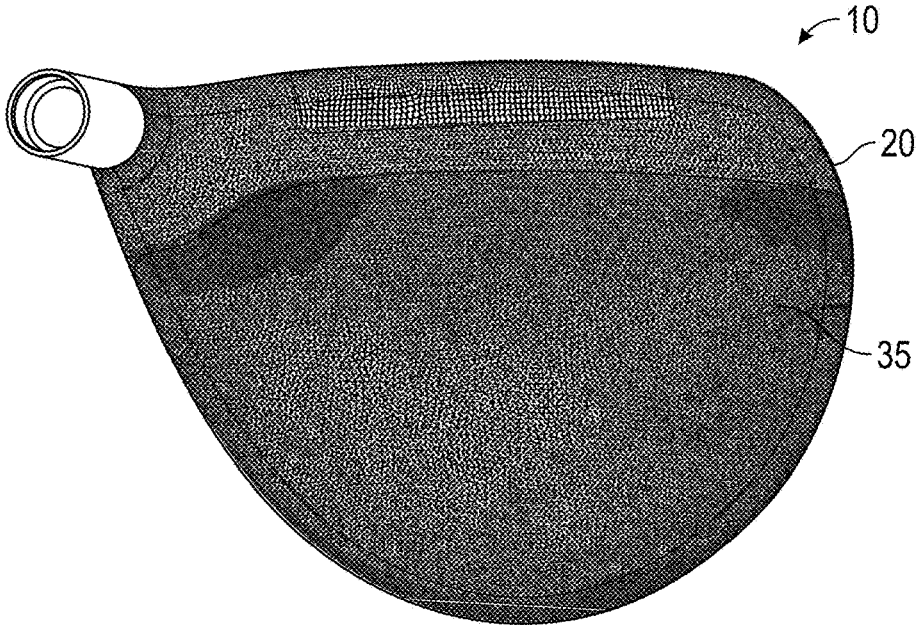
Figure 12A:
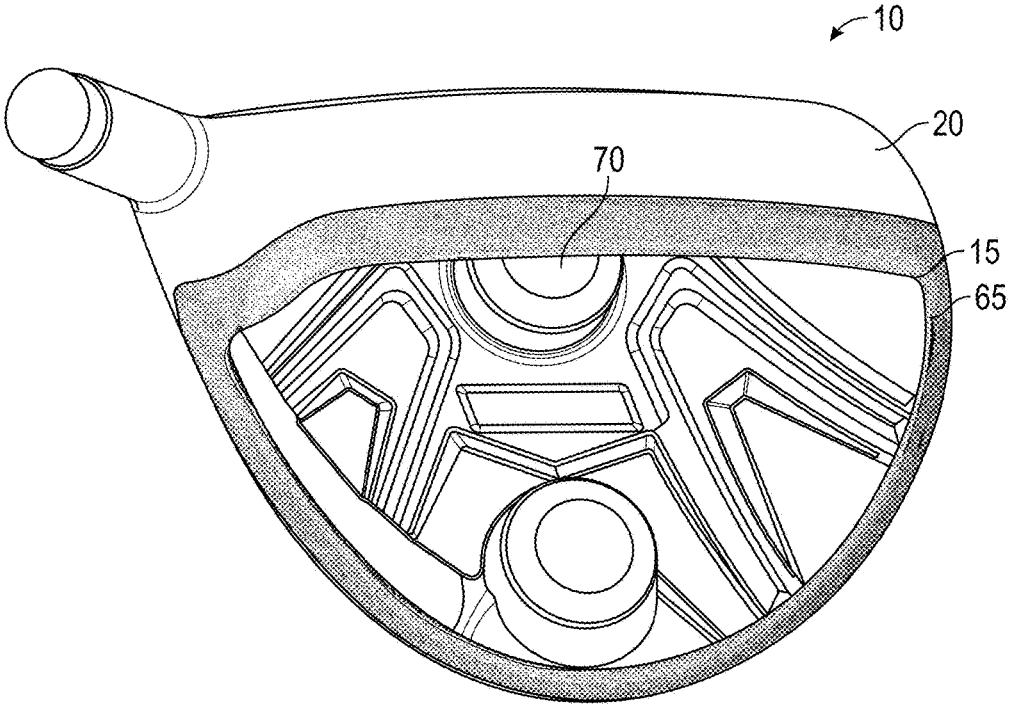
FIGS. 12A and 12B are adhesive stress contour plots of CAD models of golf club heads without their crowns undergoing a flat lie bending process.
Figure 12B:
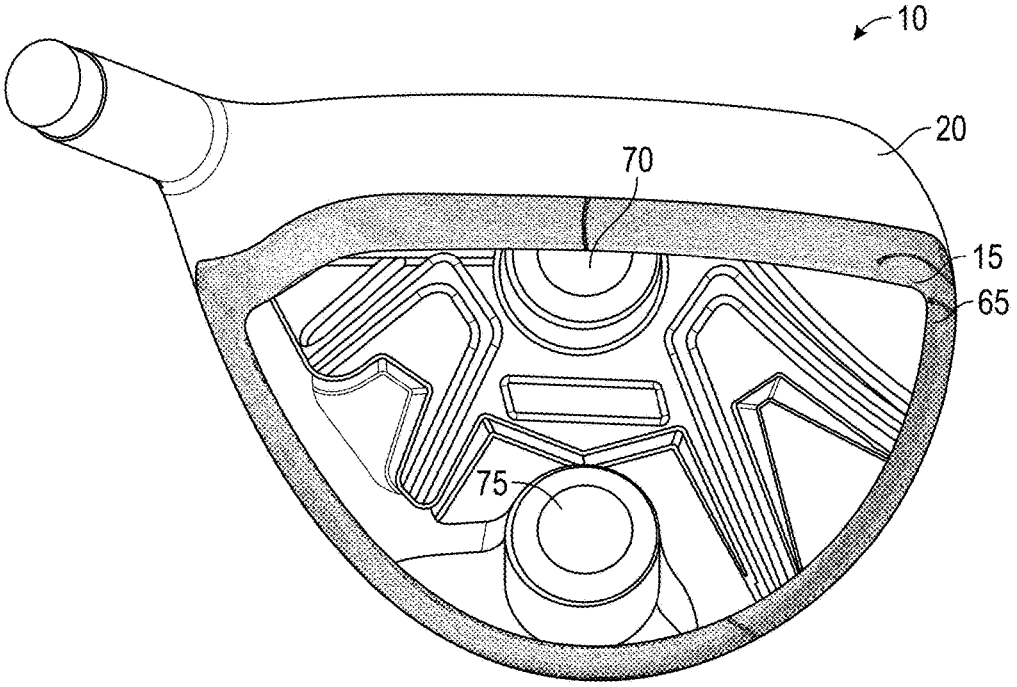
Figure 13A:
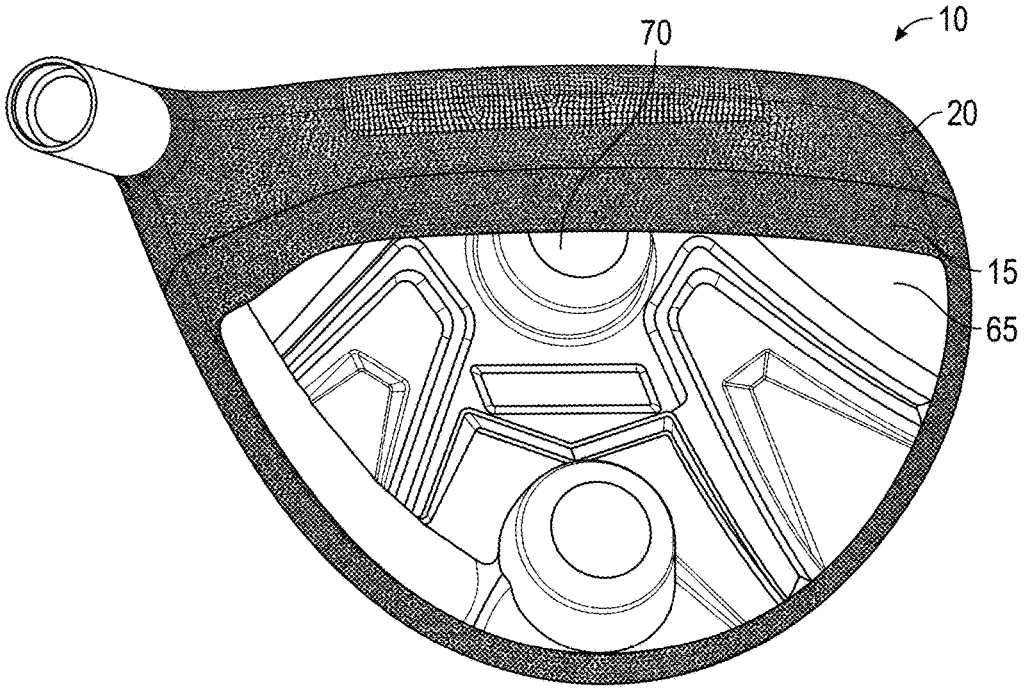
FIGS. 13A and 13B are adhesive stress contour plots of CAD models of golf club heads without their crowns undergoing a strong loft bending process.
Figure 13B:
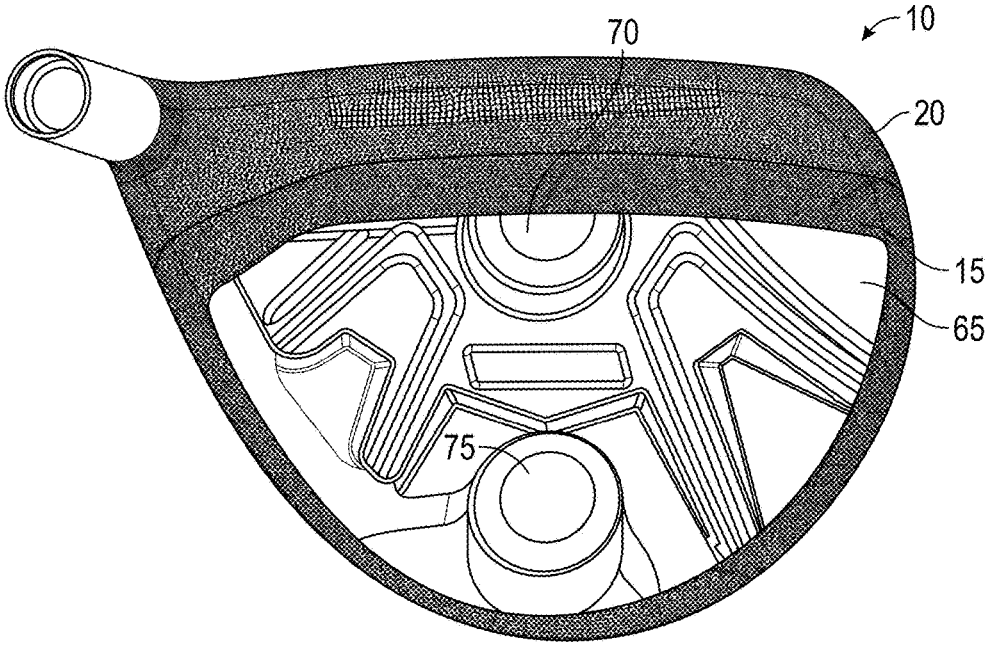

When the tube portion 42 of the hosel 40 is subjected to bending forces to change the loft or lie of the golf club head 10, the relative force is applied through the support ring 50 instead of the crown 35 or the thinner parts of the body 20, and particularly the bond flange 65 where the crown 35 is affixed to the body 20 with an adhesive material 15, thus preventing warping or breakage in these parts of the golf club head 10. FIGS. 10-14 are side by side comparisons of the preferred embodiment (B) and a golf club head having the same features except for the support ring 50 (A) being subjected to bending forces. As shown in these Figures, the support ring 50 reduces the peak stress: placed on the crown 35 during a flat lie bending process from approximately 19.9 ksi to 18 ksi (FIG. 10); placed on the crown 35 during a strong loft bending process from approximately 32.7 to 31.6 ksi (FIG. 11); placed on the adhesive material 15 during a flat lie bending process from approximately 5.6 ksi to 4.6 ksi (FIG. 12); and placed on the adhesive material 15 during a strong loft bending process from approximately 9.3 ksi to 9.0 ksi (FIG. 13).

Figure 16A:
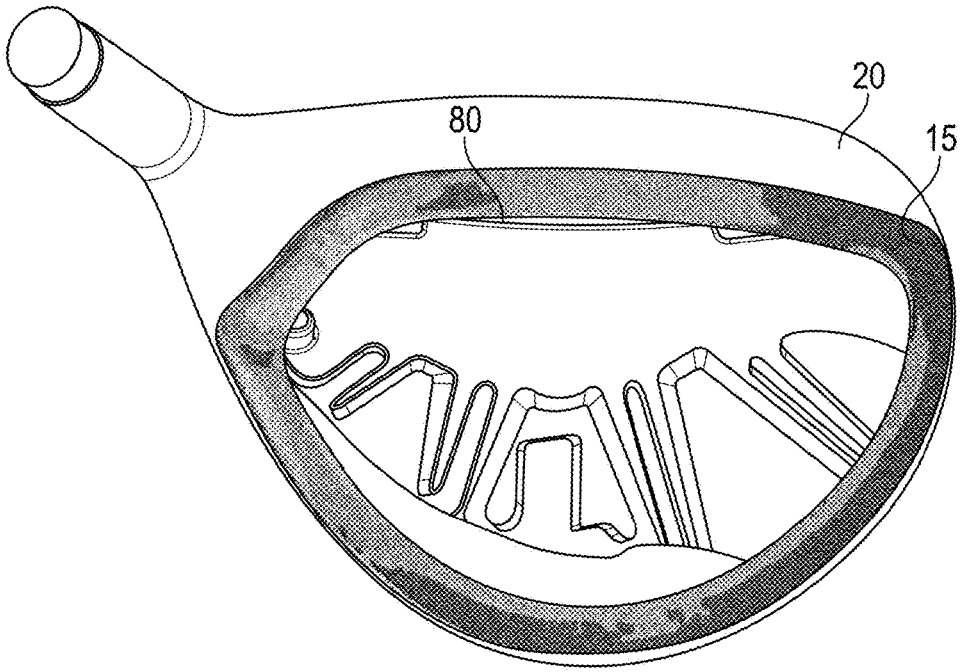
FIGS. 16A and 16B are adhesive stress contour plots of CAD models of golf club heads without their crowns undergoing a strong loft bending process.
Figure 16B:
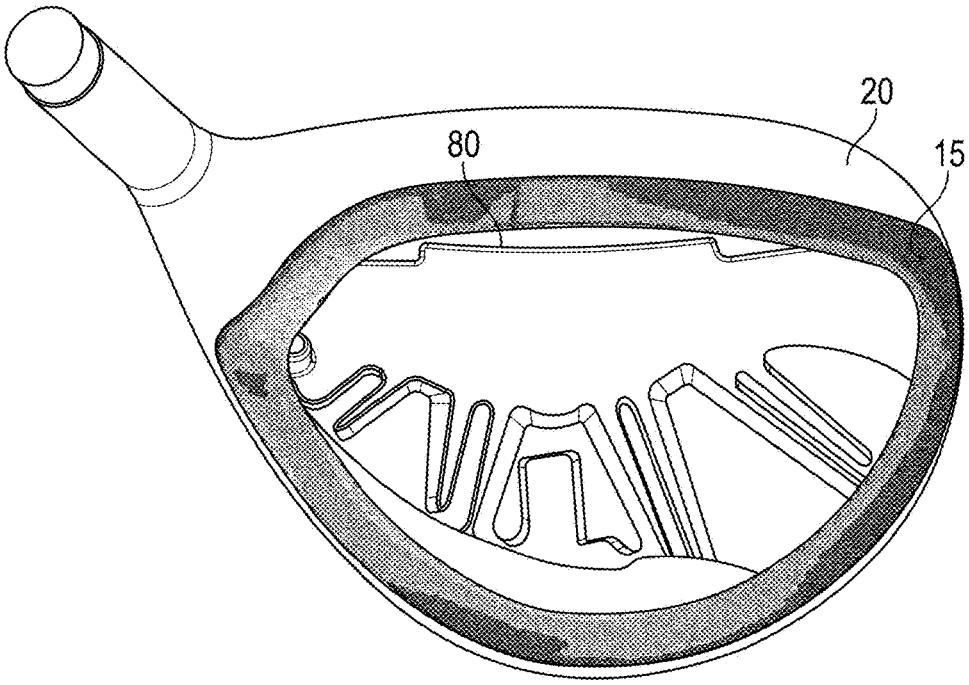
Figure 17A:
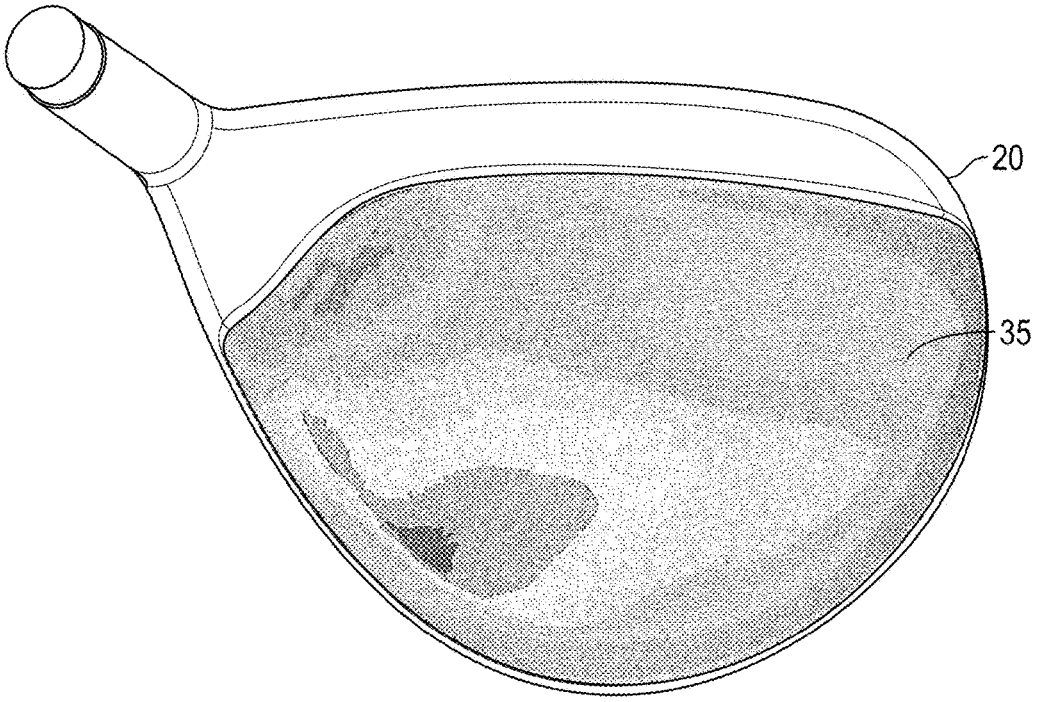
FIGS. 17A and 17B are crown stress contour plots of CAD models of golf club heads undergoing a strong loft bending process.
Figure 17B:
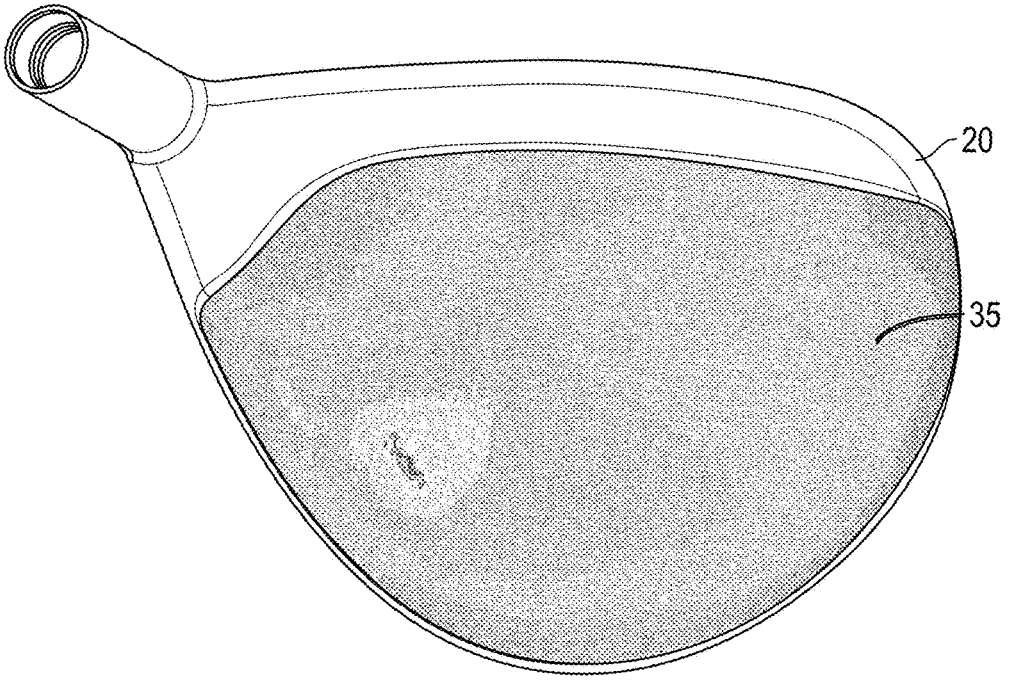
Figure 18A:
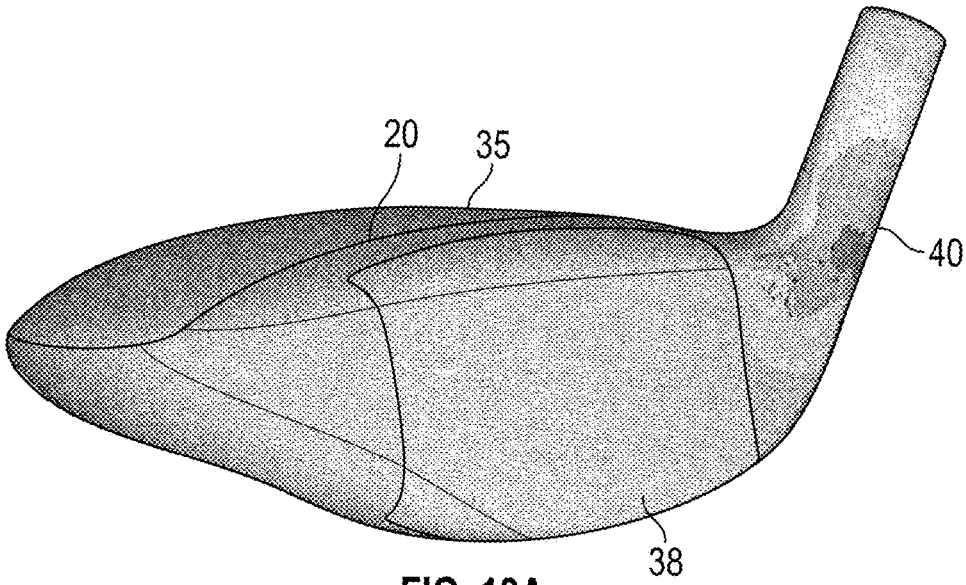
FIGS. 18A and 18B are body stress contour plots of CAD models of golf club heads undergoing a strong loft bending process.
Figure 18B:
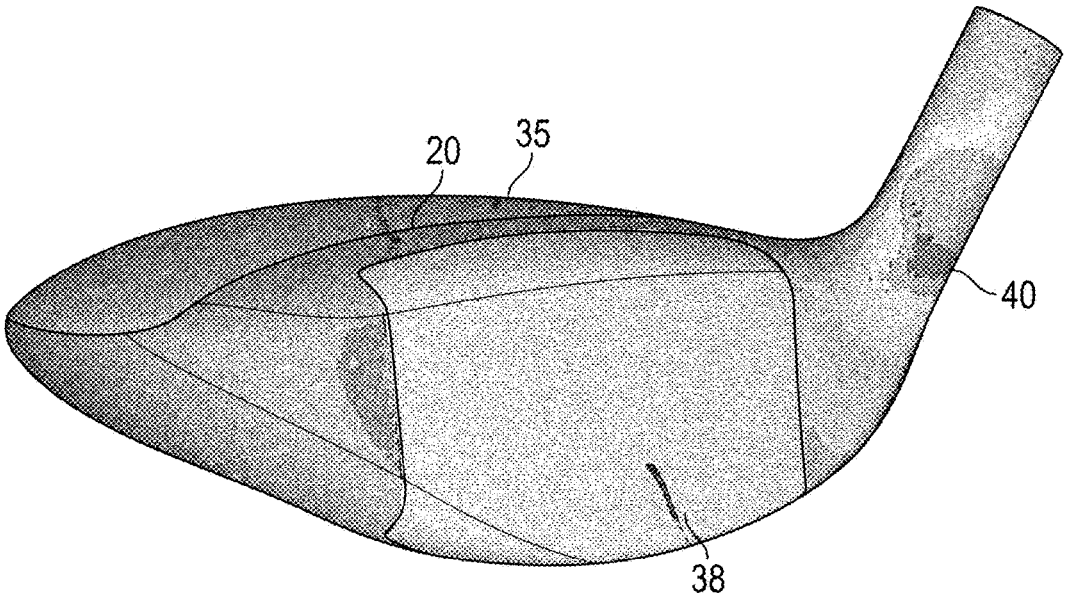

An alternative embodiment of the golf club head 10 of the present invention is shown in FIGS. 14-15. This embodiment has all of the same features as the preferred embodiment, except that it lacks the weight ports 70, 75 of the preferred embodiment and instead has a weight lip 80 like the one disclosed in U.S. Pat. No. 8,257,195, the disclosure of which is incorporated by reference in its entirety herein, and a slightly thicker wall 28 at the heel side 21 proximate the hosel 40. FIGS. 16-18 are side by side comparisons of this alternative embodiment (B) and a golf club head having all of the same features except for the support ring 50 and the thicker heel wall 28 (A) being subjected to bending forces. As shown in these Figures, the support ring 50 reduces the peak stress: placed on the adhesive material 15 during a strong loft bending process from approximately 9.4 ksi to 8.1 ksi (FIG. 16); placed on the crown 35 during a strong loft bending process from approximately 27.9 ksi to 9.3 ksi (FIG. 17); and placed on the heel side 21 of the body 20 during a strong loft bending process from approximately 223.5 ksi to 184.0 ksi (FIG. 18).

Figure 21:
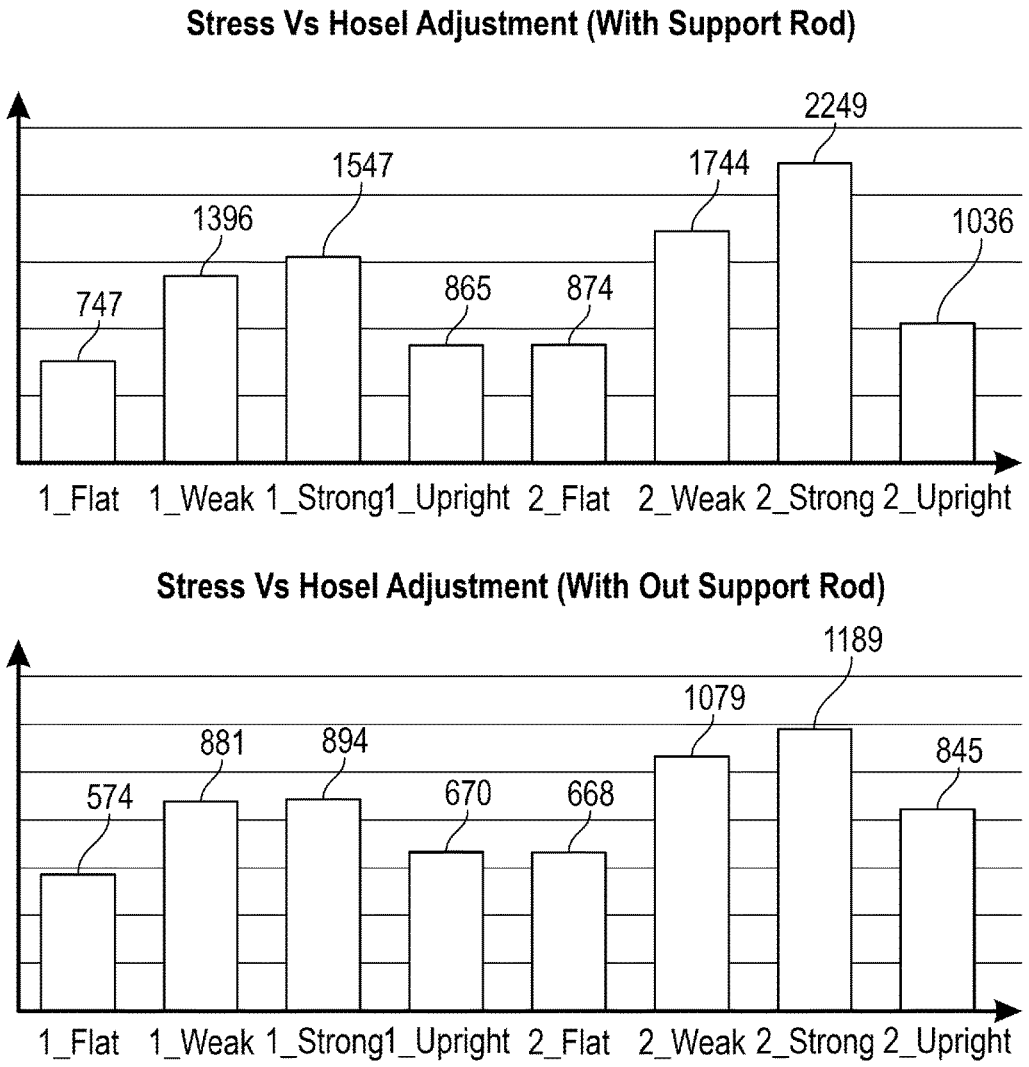
FIG. 21 shows stress plots of a golf club head with and without a hosel support rod undergoing bending processes.

The third, preferred embodiment of the present invention is shown in FIGS. 19 and 20. This embodiment includes many of the same features as the first and second embodiments, including both weight ports 70, 75 and a weight lip 80, but instead of a support ring 50, it includes a hosel support rod 100. The hosel support rod 100 extends approximately parallel with the front wall 24 through the hollow interior 26 between the sole 30 and the bond flange 65 that extends from the return portion 60. The hosel support rod 100 is entirely disposed behind the hosel 40 along a front-to-rear horizontal x-axis and heel-ward of a vertical xz plane 150 extending through the heel-most side of the opening 25 in the front wall 24. As shown in the stress plots in FIG. 21, the hosel support rod 100 reduces stress placed on the junction between the bond flange 65 and the crown 35 while the hosel undergoes flat, weak, strong, and upright, bending by 1-2° when compared with a golf club head 10 having the same features as the preferred embodiment but lacking the hosel support rod 100.

The preferred embodiment also includes stress reduction rods 120, 125 proximate the opening 25 in the front wall, which may have any of the features disclosed in U.S. Pat. Nos. 10,010,771, 9,687,701, 9,687,702, 9,694,257, 9,757,629, 9,776,058, 9,908,017, and 9,855,476, the disclosure of each of which is hereby incorporated by reference herein.

In each of the embodiments disclosed herein, the body 20 preferably is composed of a metal alloy material, and more preferably is integrally cast with the hosel 40 and support ring 50 or support rod 100 from a material such as titanium alloy or steel, though in one alternative embodiment the hosel 40 is formed separately from a lightweight material with a density of less than 3.5 g/cc, such as carbon composite or plastic, to move the center of gravity of the golf club head 10 towards the toe side 23 and to increase the bendability of the hosel 40. The support ring 50 or support rod 100 may, in alternative embodiments, be welded into the body 20 after manufacturing so that it can be made from a different material than the body 20. If a manufacturer wishes to lower the center of gravity of the club head, the support ring 50 or support rod 100 can be formed from a lightweight alloy material such as aluminum alloy, and the body 20 can be formed from a higher density alloy. The crown 35 preferably is composed of a lightweight material such as carbon composite or plastic, and is fixed to the outer surface 66 or inner surface 67, but preferably the outer surface 66, of the bond flange 65 with a permanent adhesive material 15.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a body comprising a sole, a heel side, a toe side, a front wall, a rear side opposite the front wall, a return portion extending away from the front wall towards the rear side, a front opening in the front wall, a hollow interior, and an upper opening;

a hosel connected to the body at the heel side, the hosel comprising a tube portion and a shaft receiving bore;

a face component affixed to the body to close the front opening;

a flange region defined as an interface between the tube portion and the body;

a crown affixed to the body to close the upper opening and enclose the hollow interior; and a support rod disposed within the hollow interior, wherein the support rod extends from the sole to the return portion proximate the flange region, wherein the support rod is disposed entirely behind the hosel along a horizontal, front-to rear x-axis, and heel-ward of a vertical xz plane extending through a heel-most side of the front opening, wherein the z-axis is in a vertical, sole to top direction.

2. The golf club head of claim 1, further comprising a bond flange, wherein the bond flange encircles the upper opening.

3. The golf club head of claim 1, wherein the golf club head is selected from the group consisting of a fairway wood, a driver, and a hybrid.

4. The golf club head of claim 1, wherein the body is composed of a first material having a first density, wherein the hosel is composed of a second material having a second density, wherein the crown is composed of a third material having a third density, and wherein the first density is greater than the second density and the third density.

5. The golf club head of claim 4, wherein the first material is a metal alloy, and wherein the third material is carbon composite.

6. The golf club head of claim 5, wherein the second material is an aluminum alloy.

7. The golf club head of claim 1, wherein the support rod is integrally cast with the body.

8. The golf club head of claim 7, wherein the hosel is integrally cast with the body.

9. The golf club head of claim 1, wherein the body is composed of a first material having a first density, wherein the support rod is composed of a second material having a second density, and wherein the first density is greater than the second density.

10. The golf club head of claim 1, wherein the body is integrally cast with the hosel and the support rod from a material selected from the group consisting of titanium alloy and steel, and wherein the crown is composed of a carbon composite material.

11. The golf club head of claim 1, wherein the golf club head has a volume of 50 to 250 cubic centimeters.

12. The golf club head of claim 1, further comprising at least one of a weight port and a weight lip.

13. The golf club head of claim 12, wherein the golf club head comprises two weight ports and a weight lip.

14. A wood-type golf club head comprising:

a cast metal body comprising a sole, a heel side, a toe side, a front wall, a rear side opposite the front wall, a return portion extending away from the front wall towards the rear side, an upper opening, a front opening in the front wall, a hosel, a flange region, a support rod, and a volume of 50-250 cubic centimeters;

a face component affixed to the body to close the front opening; and a carbon composite crown affixed to the body to close the upper opening and define a hollow interior, wherein the flange region is defined as an interface between the hosel and the rest of the body, wherein the support rod is contained within the hollow interior proximate the flange region and extends from the sole to the return portion approximately parallel with the front wall, and wherein the support rod is disposed entirely behind the hosel along a horizontal, front-to rear x-axis, and heel-ward of a vertical xz plane extending through a heel-most side of the front opening, wherein the z-axis is in a vertical, sole to top direction.

15. The wood-type golf club head of claim 14, further comprising a bond flange, wherein the bond flange encircles the upper opening, and wherein the crown is permanently affixed to an exterior surface of the bond flange with an adhesive material.

16. The wood-type golf club head of claim 14, further comprising at least one of a weight port and a weight lip.

17. The wood-type golf club head of claim 16, wherein the golf club head comprises two weight ports and a weight lip.

* * * * *